US010959532B2

(12) United States Patent
Gao et al.

(10) Patent No.: US 10,959,532 B2
(45) Date of Patent: Mar. 30, 2021

(54) BACK ADJUSTABLE ELECTRICAL BED FRAME

(71) Applicant: Zhejiang Sidoo Electrical Appliances Co., Ltd., Jiaxing (CN)

(72) Inventors: Xuefeng Gao, Jiaxing (CN); Yun Zhao, Jiaxing (CN)

(73) Assignee: Zhejiang Sidoo Electrical Appliances Co., Ltd., Jiaxing (CN)

( * ) Notice: Subject to any disclaimer, the term of this patent is extended or adjusted under 35 U.S.C. 154(b) by 357 days.

(21) Appl. No.: 16/069,729

(22) PCT Filed: May 27, 2017

(86) PCT No.: PCT/CN2017/086279
§ 371 (c)(1),
(2) Date: Jul. 12, 2018

(87) PCT Pub. No.: WO2018/120630
PCT Pub. Date: Jul. 5, 2018

(65) Prior Publication Data

US 2019/0021510 A1 Jan. 24, 2019

(30) Foreign Application Priority Data

Dec. 30, 2016 (CN) ..... 201611257411.4

(51) Int. Cl.
*A47C 20/04* (2006.01)
*A61G 7/015* (2006.01)
(Continued)

(52) U.S. Cl.
CPC ..... *A47C 20/041* (2013.01); *A47C 19/021* (2013.01); *A47C 20/08* (2013.01);
(Continued)

(58) Field of Classification Search
CPC ..... A47C 20/041; A47C 20/08; A47C 19/021; A47C 7/015; A47C 7/018; A47C 7/065;
(Continued)

(56) References Cited

U.S. PATENT DOCUMENTS 618,407 A * 1/1899 Forbes ..... A61G 7/015 5/617
2,470,161 A * 5/1949 Glasin ..... A61G 7/015 5/618

(Continued)

FOREIGN PATENT DOCUMENTS

CN 105534138 A 5/2016

OTHER PUBLICATIONS

International Search Report and Written Opinion dated Sep. 22, 2017, issued in corresponding International Patent Application No. PCT/CN2017/086279.

(Continued)

*Primary Examiner* — Nicholas F Polito
*Assistant Examiner* — Morgan J McClure
(74) *Attorney, Agent, or Firm* — IPro, PLLC

(57) ABSTRACT

A back adjustable electrical bed frame comprises a head panel, a back panel, a buttocks panel, a thigh panel, a shank panel, a back pusher motor and a leg pusher motor. The leg pusher motor drives the buttocks panel through a scissor support assembly. The shank panel, parallel to the base, moves back and forth. The back panel has a back panel pivot at a quarter to a half of its lower part. The back panel is fixed to the base by a column having one end fixed to the base and the other end connected to the back panel pivot. The back pusher motor has a front end pivot connected with the back panel and a rear end pivot fixedly connected with the base. The front end pivot, the rear end pivot and the back panel pivot form a triangle to position an angle of the back panel.

6 Claims, 4 Drawing Sheets

(51) Int. Cl.

| | |
|---|---|
| ***A47C 19/02*** | (2006.01) |
| ***A61G 7/018*** | (2006.01) |
| ***A61G 7/065*** | (2006.01) |
| ***A47C 20/08*** | (2006.01) |
| ***A61G 13/02*** | (2006.01) |
| ***A61G 13/08*** | (2006.01) |
| ***A61G 1/013*** | (2006.01) |

(52) U.S. Cl.
CPC ..... *A61G 7/015* (2013.01); *A61G 7/018* (2013.01); *A61G 7/065* (2013.01); *A61G 1/013* (2013.01); *A61G 13/02* (2013.01); *A61G 13/08* (2013.01); *A61G 2203/12* (2013.01)

(58) Field of Classification Search
CPC .... A61G 2203/12; A61G 1/013; A61G 13/02; A61G 13/08
See application file for complete search history.

(56) References Cited

U.S. PATENT DOCUMENTS 2,988,758 A * 6/1961 Donaldson ..... A61G 7/015 5/616
3,261,639 A * 7/1966 Phillips ..... A47C 20/08 297/83
3,289,222 A * 12/1966 Nielsen ..... A61G 7/015 5/617
3,743,344 A * 7/1973 Jameson ..... A61G 1/0567 296/20
3,793,652 A * 2/1974 Linehan ..... A61G 7/002 5/607
4,395,786 A * 8/1983 Casey ..... A61G 7/015 5/616
4,403,357 A * 9/1983 Degen ..... A47C 17/04 5/618
4,792,110 A * 12/1988 Bond ..... B23Q 1/5468 248/651
4,944,055 A * 7/1990 Shainfeld ..... A47C 17/175 5/618
5,160,010 A * 11/1992 Peterson ..... A47C 19/045 188/67
5,245,718 A * 9/1993 Krauska ..... A61G 7/015 5/618
5,305,482 A * 4/1994 Dewert ..... A47C 20/041 5/611
5,315,726 A * 5/1994 Borenstein ..... A47C 19/22 297/161
5,392,479 A * 2/1995 Liao ..... A61G 7/001 5/607
5,402,544 A * 4/1995 Crawford ..... A61G 5/006 297/344.17
5,404,604 A * 4/1995 Has ..... A47C 20/041 5/617
5,481,769 A * 1/1996 Schneider ..... A47C 20/041 5/424
5,613,255 A * 3/1997 Bish ..... A61G 7/005 5/610
5,678,264 A * 10/1997 Walker ..... A47C 17/1756 297/354.13
5,996,151 A * 12/1999 Bartow ..... A61G 1/017 5/611
6,694,549 B2 * 2/2004 Perez ..... A61G 7/015 5/613
7,146,662 B1 * 12/2006 Pollard ..... A47B 91/16 5/617
7,810,189 B2 * 10/2010 Boudreau ..... A47C 19/22 5/618
7,849,539 B2 * 12/2010 Hornbach ..... A61G 7/015 5/618
7,913,336 B2 * 3/2011 Morin ..... A61G 7/018 5/617
8,069,513 B2 * 12/2011 Turner ..... A61G 7/07 5/618
10,729,246 B2 * 8/2020 Sweeney ..... A47C 17/16
2003/0093863 A1 * 5/2003 Grove ..... A61G 7/053 5/618
2005/0091747 A1 * 5/2005 Freeborn ..... B60B 33/0068 5/611
2005/0166323 A1 * 8/2005 Kawakami ..... A61G 7/001 5/610
2005/0268401 A1 * 12/2005 Dixon ..... A61G 7/008 5/655.3
2006/0026762 A1 * 2/2006 Hornbach ..... A61G 7/0528 5/611
2007/0000056 A1 * 1/2007 Ward ..... A61G 1/013 5/611
2007/0017029 A1 * 1/2007 Wurdeman ..... A61G 7/00 5/618
2008/0155750 A1 * 7/2008 Mossbeck ..... A61G 7/015 5/618
2008/0229503 A1 * 9/2008 Bzorgi ..... A61G 1/013 5/620
2008/0276372 A1 * 11/2008 Lambarth ..... A61G 1/0237 5/611
2008/0276373 A1 * 11/2008 Clenet ..... A47C 20/08 5/618
2009/0165207 A1 * 7/2009 Reed ..... B60T 7/04 5/611
2012/0050058 A1 * 3/2012 Brondum ..... A61G 7/018 340/686.1
2012/0297543 A1 * 11/2012 Robertson ..... A47C 20/041 5/616
2017/0172827 A1 * 6/2017 Schaaf ..... A61G 7/018
2017/0252244 A1 * 9/2017 Zhou ..... A47C 20/08
2018/0055701 A1 * 3/2018 Tang ..... A61G 1/042
2018/0103768 A1 * 4/2018 Nava ..... A47C 19/02
2018/0153752 A1 * 6/2018 Kostic ..... G06F 3/04817
2018/0242751 A1 * 8/2018 MacNaughton ..... A47C 15/008
2018/0271298 A1 * 9/2018 Alletto, Jr. ..... A61G 7/015
2018/0318155 A1 * 11/2018 Zheng ..... A61G 1/013
2019/0069687 A1 * 3/2019 Liang ..... A47C 20/041
2019/0083337 A1 * 3/2019 Tessmer ..... A61G 7/015

OTHER PUBLICATIONS

Office Action dated Jan. 17, 2018, issued in corresponding Chinese Patent Application No. 2018011201520420.

* cited by examiner

BACK ADJUSTABLE ELECTRICAL BED FRAME

TECHNICAL FIELD

The invention relates to an electric bed frame, and more particularly to a back-hanging-down type electric care bed frame.

BACKGROUND TECHNOLOGY

The bed is an indispensable piece of furniture for every family. With the gradual improvement of living standards, people also have a higher pursuit on the aesthetics, comfort and functionality of the bed.

Electric bed is one of the more functional of a modern home bed. The head of the bed plate or the foot height of the electric bed can be controlled and the degree of bending of the bed can be freely adjusted. Electric bed can be divided into two different types of skeleton and bed plate, the skeleton type is called European electric bed, and the bed plate type is called American electric bed.

Head and tail lifting function: compared with the use of health care, the lifting function is more perfect and diversified. According to ergonomics there is five body segmentation joints in the bed frame (that is, the bending point of the human body), the bed frame angle can be adjusted through remote control operation to adapt to the various parts of the body bending angle and adjust the body posture freely, so that the neck pressure can be reduced, sitting, lying or only raise the feet to promote blood circulation.

A variety of mattresses can be placed on the electric mats to combine into a modern home bed. The electric beds of the existing domestic production, generally are American four state or five state, which are divided into the head, back, buttocks, thigh, shank and head and back together.

The existing electric bed is already with reasonable function and simple structure. Compared with ordinary flat bed, the existing electric bed is more comfortable and humanized. But there are still several problems or flaws to be improved and upgraded.

First, the existing electric bed is single-axis rotation, the section of the joints and the mattress are significantly disengaged, not posted and left an increasing gap when the back rest is raised with a large angle, the reason is the mattress has a certain hardness which can not be completely folded into a dead end, and the thicker and harder the mattress is, the outer diameter of its bending is greater. However, the folding angle R is basically 0, so there will be a triangular gap at the bending part of the buttocks and back which will affect the aesthetics but will not affect the use of functionality.

Second is the mismatch problem, as the mattress has a certain thickness, hardness, there will be a certain bending radius after bending. For example, the middle layer of the sponge bed with 2 meters long and 20 centimeters, the back bends 70 degrees, the thigh bends 30 degrees, the length of lower side of the extension reaches 2.14 meters, however, the total length of the bed frame is only 2 meters, the dislocation is nearly 14 centimeters, that is, the mattress will protrude a distance from the bed frame after the rise of the bedside which will affect the aesthetics.

Third is the push back friction: whether it is state four or state five, currently the pivot of the back of the electric bed is configured at the bottom of the backrest bracket. As shown in FIG. 1, the back panel pivot 14 is at the bottom of the back panel 2. After the mattress is behind the buttocks waist, when the back pusher motor 8 be pushed back, the backrest bracket and mattress relative displacement, coupled with the relative thickness of the human body with the mattress produced, the process of getting up, the body back side and mattresses have a strong friction, that is, the back of the human to be up, the clothes were pulled by the mattress which will be very uncomfortable. Get up the process of action, to constantly move the buttocks and back to eliminate the friction. This defect is prevalent in all electric beds on the market now.

CONTENTS OF THE INVENTION

The technical problem to be solved by the invention is to provide a back adjustable electrical bed frame which can avoid the large dislocation between the mattress and the mattress when the backrest stands up, and reduce the push-back and pull feeling of the mattress and the human body's large dislocation friction, thereby reducing the noise generated by the dislocation, improving the comfort of the electric bed.

The technical proposal for solving the above technical problem of the invention is to provide aback adjustable electrical bed frame, comprising a head panel, a back panel, a buttocks panel, a thigh panel and a shank panel, a back pusher motor and a leg pusher motor are configured below the back panel, the leg pusher motor drives the buttocks panel through a scissor support assembly, the shank panel moves back and forth and parallel to the base, a back panel pivot is configured at a quarter to a half of the lower part of the back panel, the back panel is fixed to the base by means of a column, one end of the column is fixed to the base and the other end of the column is connected to the back panel pivot, the front end pivot of the back pusher motor is connected with the back panel, and the rear end pivot is fixedly connected with the base; the front end pivot of the back pusher motor, the rear end pivot of the back pusher motor and the back panel pivot form a triangle to position the angle of the back panel.

The back adjustable electrical bed frame, wherein said head panel is rotatably connected with the back panel by means of a hinge; a head motor front fastener is configured on the head panel, a head motor rear fastener is configured on the back panel, the head motor front fastener and the head motor rear fastener are connected to each other by means of a head fader motor to adjust the relative angle of the head panel and the back panel.

The back adjustable electrical bed frame, wherein said head panel and the back panel are the same panel.

The back adjustable electrical bed frame, wherein said back panel pivot is configured at a third of the lower part of the back panel.

The back adjustable electrical bed frame, wherein one end of said thigh panel is rotatably connected to the buttocks panel by a hinge, the other end of the thigh panel is rotatably connected to the shank panel by the hinge; two first scissors support are configured side by side in the lower shank panel by a intermediate pivot, two second scissors support are configured side by side in the lower shank panel by the intermediate pivot, the four ends of the two first scissors support are free to slide, the right lower end of the two second scissors support are fixed to the base, the other three ends are free to slide; the left lower end of the two second scissors support are connected by a scissors rod, the scissors rod and a leg pusher motor are connected.

The back adjustable electrical bed frame, wherein said four ends of each of the first scissors are configured in the bearing chute by means of a rolling bearing; the right lower end of each second scissors support is configured with a fixed rotary pivot and the other three ends are configured in the bearing chute by means of a rolling bearing.

The back adjustable electrical bed frame, wherein said back pusher motor and the leg pusher motor are configured by side, and the back pusher motor and the leg pusher motor are fixed to the base by a double motor rear fastener.

The back adjustable electrical bed frame, wherein said back pusher motor controls the lifting angle of the back panel by pulling back the back panel using the reverse loading method.

The invention compares to the prior art with the following advantages: the back adjustable electrical bed frame provided by the invention can make the buttocks position sinks by setting the back panel pivot position in the middle or middle lower of the back panel instead of the bottom position, which can avoid the large dislocation between the mattress and the mattress when the backrest stands up, and reduce the push-back and pull feeling of the mattress and the human body's large dislocation friction, thereby reducing the noise generated by the dislocation, improving the comfort of the electric bed.

| | | |
|---|---|---|
| 1 head panel | 2 back panel | 3 a buttocks panel |
| 4 thigh panel | 5 shank panel | 6 hinge |
| 7 base | 8 back pusher motor | 9 leg pusher motor |
| 10 double motor rear fastener | 11 head fader motor | 12 head motor front fastener |
| 13 head motor rear fastener | 14 back panel pivot | 15 intermediate pivot |
| 16 bearing pivot | 17 bearing | 18 bearing chute |
| 19 putter head | bearing cover | 21 scissors support shaft |
| 22 column | 23 first scissors support | 24 second scissors support |
| 801 front end pivot | 802 rear end pivot | 803 motor putter |

DETAILED DESCRIPTION

The invention will now be further described below with reference to the accompanying drawings and examples.

Figure 1:
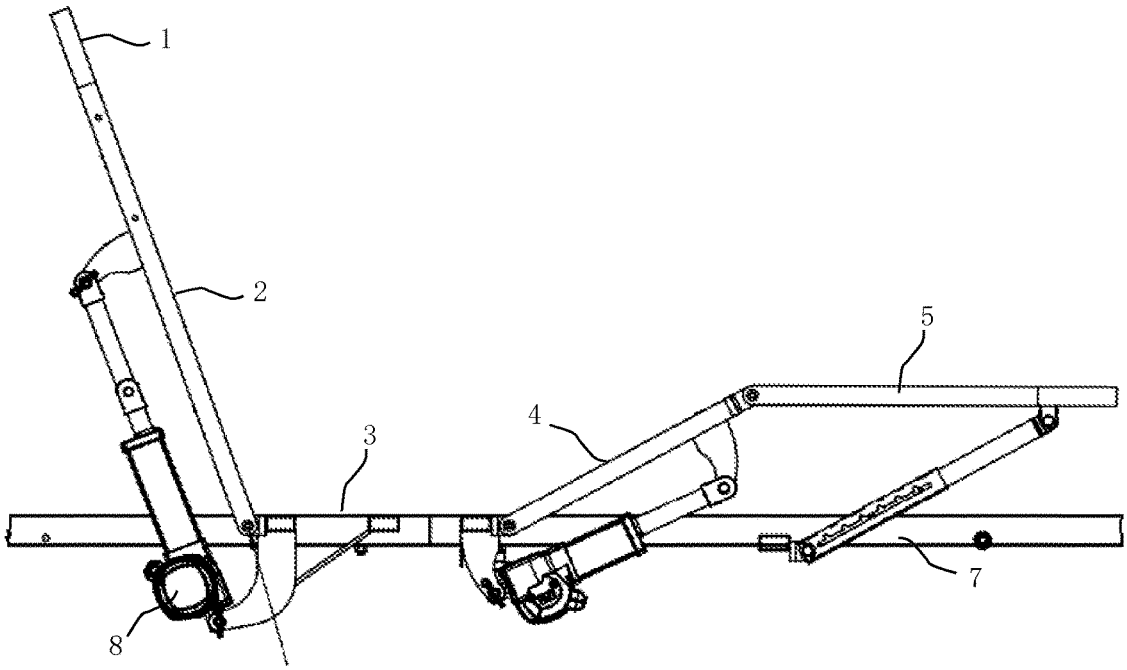
FIG. 1 is the installation diagram of the bed frame structure and the back shaft of the existing electric bed.
Figure 2:
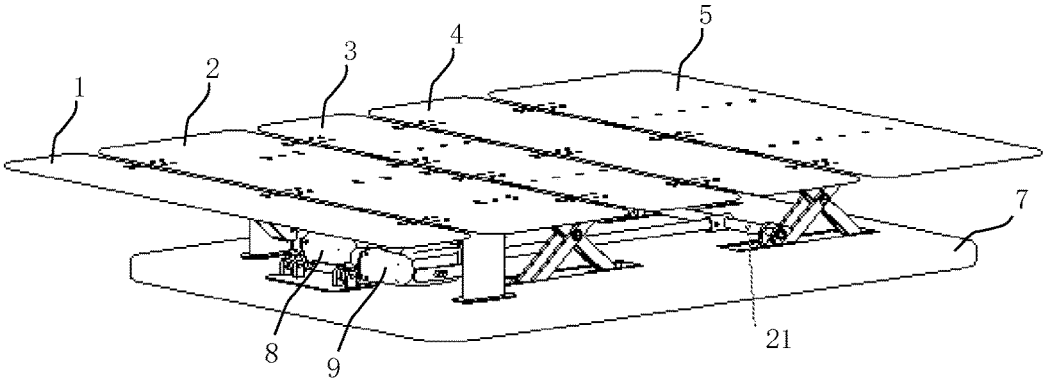
FIG. 2 is a structure illustration of the back adjustable electrical bed frame of the invention when laying flat.
Figure 3:
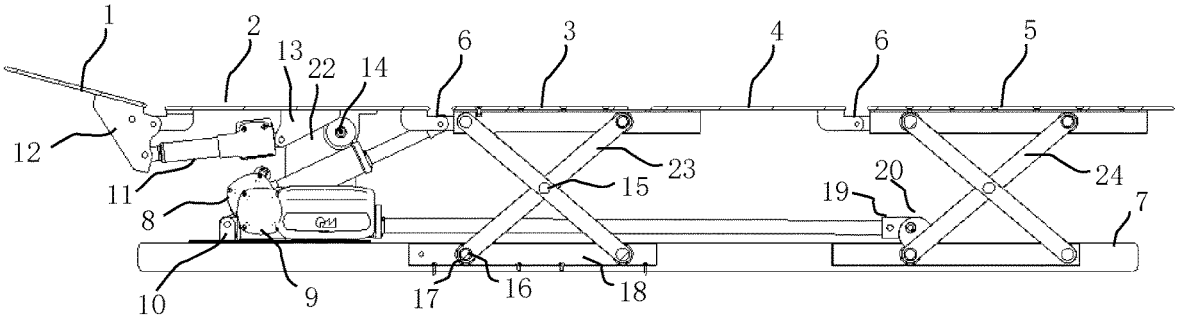
FIG. 3 is a side structure illustration of the back adjustable electrical bed frame of the invention when laying flat.
Figure 4:
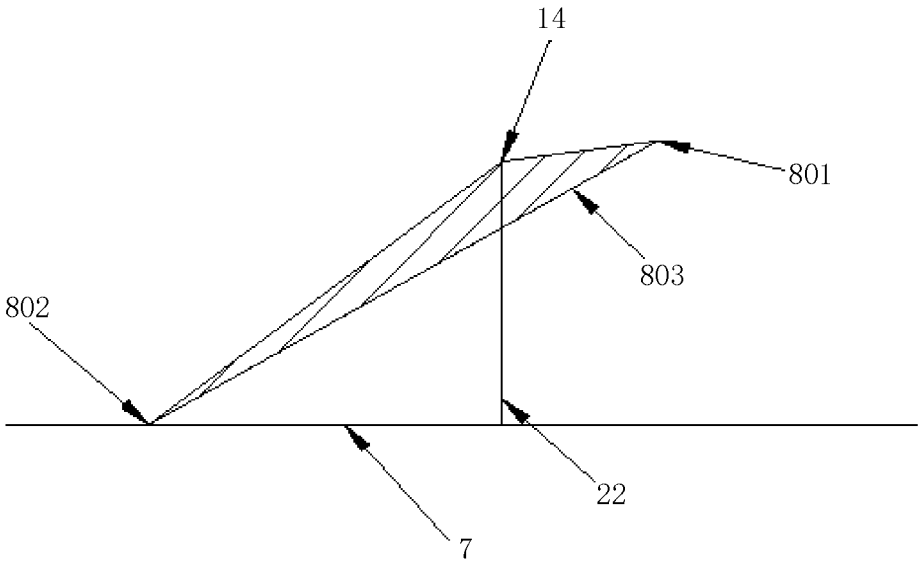
FIG. 4 is a triangle positioning back panel structure illustration formed when the electric bed frame of the invention is raised.

FIG. 2 is a structure illustration of the back adjustable electrical bed frame of the invention when laying flat; FIG. 3 is a side structure illustration of the back adjustable electrical bed frame of the invention when laying flat; FIG. 4 is a triangle positioning back panel structure illustration formed when the electric bed frame of the invention is raised.

Please refer to FIG. 2, FIG. 3 and FIG. 4, the back adjustable electrical bed frame provided by the invention, comprising a head panel 1, a back panel 2, a buttocks panel 3, a thigh panel 4 and a shank panel 5, a back pusher motor 8 and a leg pusher motor 9 are configured below the back panel 2, the leg pusher motor 9 drives the buttocks panel 3 through a scissor support assembly, the shank panel 5 moves back and forth and parallel to the base 7, a back panel pivot 14 is configured at a quarter to a half of the lower part of the back panel 2, the back panel 2 is fixed to the base 7 by means of a column 22, one end of the column 22 is fixed to the base 7 and the other end of the column 22 is connected to the back panel pivot 14, the front end pivot 801 of the back pusher motor 8 is connected with the back panel 2, and the rear end pivot 802 is fixedly connected with the base 7; the front end pivot 801 of the back pusher motor 8, the rear end pivot 802 of the back pusher motor 8 and the back panel pivot 14 form a triangle to position the angle of the back panel by a motor putter 803.

In the invention, the back panel pivot 14 is moved from the original backrest buttocks joint, that is, the bottom of the backrest bracket, to a quarter to a half of the back bracket, preferably about one third of the back bracket (about move up the distanced of 170 mm), this design make the rotation center fall to the bottom of the human back, so that the space position can be let out, and the back pusher motor 8 can be anti-installed. Originally the backrest can only be raised by thrust, but now the backrest can also be raised by pull. The back pusher motor can be installed or anti-installed is determined by the designer, and each has its own advantages and disadvantages, theoretically the strength of the motor putter compression is higher than strength of the tensile, however, in actual use there will be no force more than the deformation force. With the back up, the installed motor will be exposed on the outside which will be easy to be seen, and the aesthetics will be affected. Anti-installed motor is easy to hide, but long time to use the motor tension will relatively reduce the motor life. The moving back of the pivot of the backrest, the motor can be installed or anti-installed depending on the design demands.

As the shaft is moved up, the process of raising the backrest becomes two opposite processes, above the back panel pivot 14, the majority of the head and back above the waist of the human body is in the upward rotation state, and under the back panel pivot 14, the lower body under the waist of the human body, especially the buttocks, are in the bend down state. The two opposite actions make the displacement of the mattress offset each other, the raising process of the backrest makes the friction between the back of the human body and the mattress to maintain in a very small state.

In addition, the moving up of the back panel pivot 14 (raising pivot) makes the upwards force of the back panel 2 greatly reduces, the power consumption of the electric bed can be greatly reduced as the reduction of the push and the pull force of the motor. The down process without friction of the lower body makes people feel floating when using the electric bed.

Figure 5:
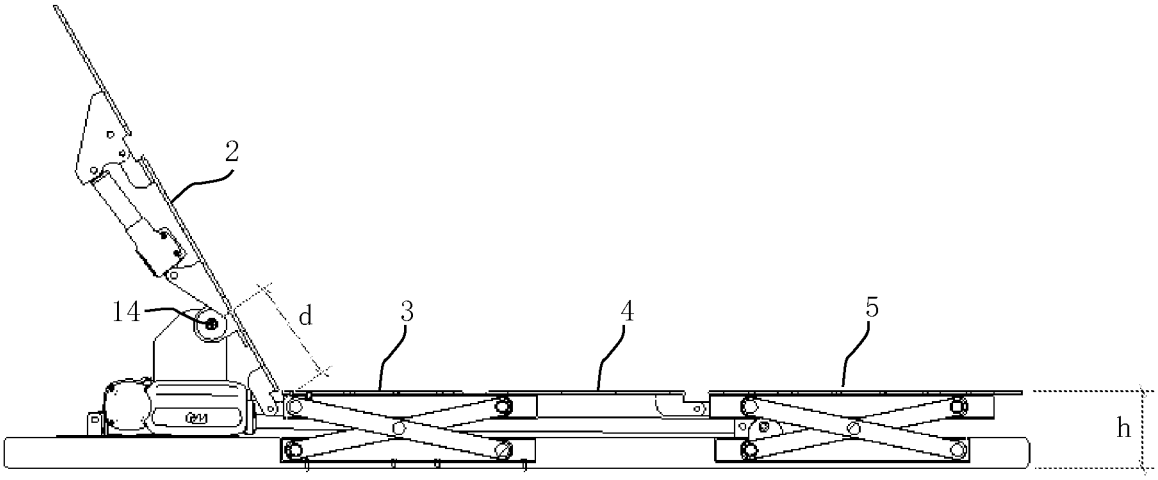
FIG. 5 is a side structure illustration when the head and back of the back adjustable electrical bed frame of the invention is raised and the leg of the back adjustable electrical bed frame of the invention is flattened.

Please continue to FIG. 5, the changes in the state of the body can be seen by moving back the raising pivot of the back of the body in the invention: 1) The back of the body is into two parts of the direction of the movement, rotating down while rotating up. The movement can offset part of the torque which reducing working pressure of the motor. 2) floating bed frame: the head and the back is in the raising state and the legs are in the flattened state, the buttocks, thighs and calf hip position has been decreased significantly after the raising of the back, which makes a slight sense of weight loss, and the lowering of the height of the bed makes people with mobility problems getting out of bed easily. There is only 127 mm from the ground to the lowest position of height of the bed frame, so the users can get out of the bed with great facilitation.

Figure 6:
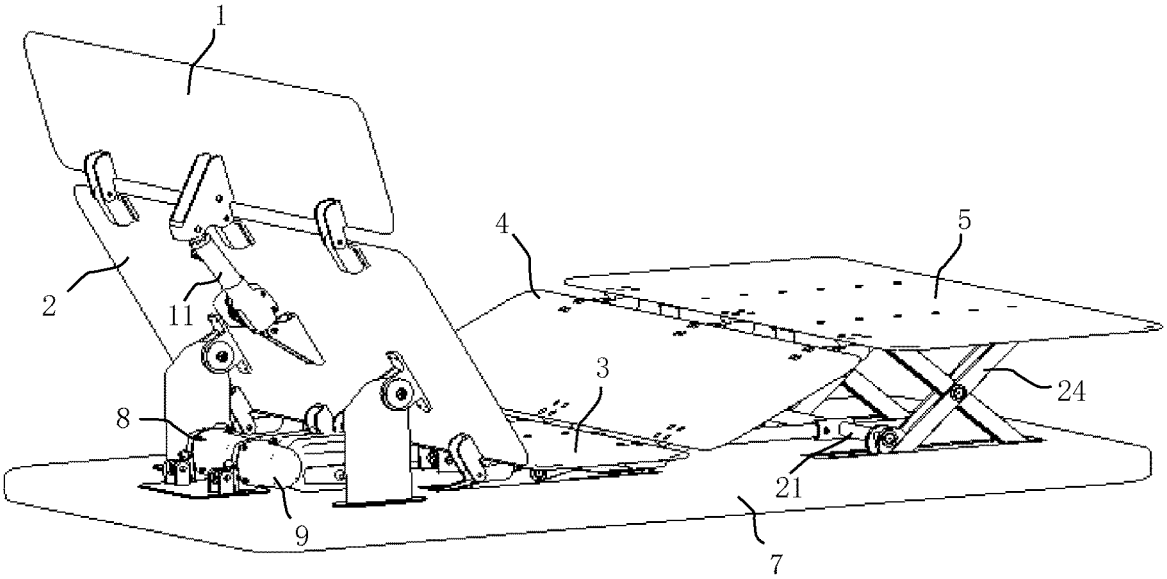
FIG. 6 is a structure illustration of the back adjustable electrical bed frame of the invention when the backrest is raised.
Figure 7:
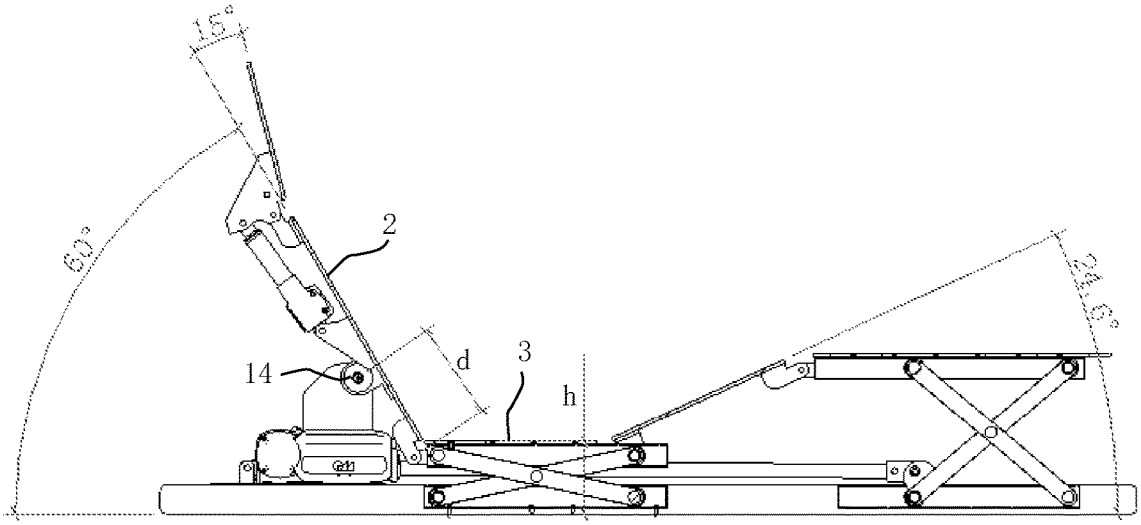
FIG. 7 is a side structure illustration of the back adjustable electrical bed frame of the invention when the backrest is raised.

Please continue to FIGS. 5 and 6, in the invention the panels may be intermeshed by the hinges 6, the hinges 6 are screwed to the panel, and the hinges 6 are used as rotating pivots with the hinge pin. The head panel 1 is rotatably connected to the back panel 2 by means of the hinge 6. The angle of the head panel 1 is controlled by adjusting the relative angle of the head panel and the back panel using the head motor 11. The head motor front fastener 12 and the head motor rear fastener 13 are fastened to corresponding panels by screws.

In the invention the buttocks panel 3 can be held parallel with the base 7 by the c in the low part. The number of the first scissors support 23 is two, and the two of the first scissors support 23 are connected by the intermediate pivot 15. Each of the first scissors support 23 is made up of scissors support shaft, bearing 16, bearing chute 17 and bearing chute 18. The upper part of the bearing chute is fixed to the buttocks panel by screws, and the lower part of the bearing chute is fixed to the base 7 by screws. One end of the scissors support shaft is positioned on the upper part of the bearing chute through the hinge pin, and the bearing 17 is free to slide in the remaining three positions of the bearing chute 18. The thigh panel 4, the front buttocks panel 3 and the back shank panel 5 are rotatably connected by the panel hinge 6 freely.

Figure 8:
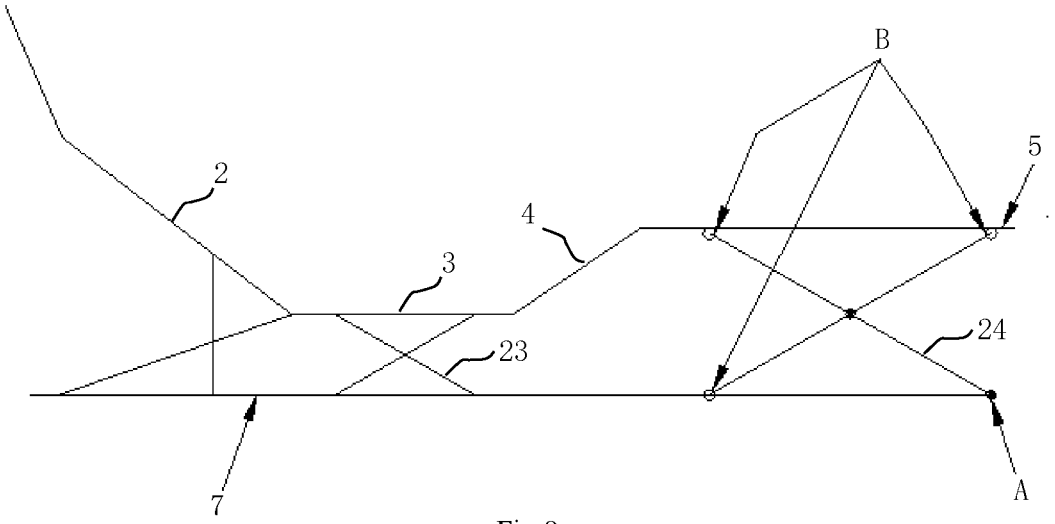
FIG. 8 is a illustration of the electric bed frame of the invention when the scissors support is moving.

The shank panel 5 can be held parallel with the base 7 by the second scissors 24, the number of the second scissors 24 is two, the two second scissors 24 are connected by the intermediate pivot 15. The height of the panel is controlled by the leg pusher motor 9, and the height of the shank panel 5 is controlled by controlling the angle of the scissors support through the putter head 19, the scissors support shaft and bearing cover. The lower right end A of the two second scissors 24 are fixed on the base 7, and the remaining tree ends B are free to slide. As shown in FIG. 8, the lower left end of the second scissors 24 are connected by the scissors support shaft 21, the scissors support shaft 21 is connected to the leg pusher motor.

In view of the above, in the invention the back panel pivot is configured in the position of the middle or the lower than the middle position of the back panel, other than the position of the bottom of the back panel, which make the position of the buttocks sinking. The advantage of the invention are as follows: 1) the effect of getting up is good, the feeling of pushing the back can be eliminated; 2) the pull force can be reduced by the back motor, and the energy can be saved; 3) the getting up height of the lower body of the human is low after the raising of the backrest so that it is easy to go to bed or get out of the bed.

While the invention has been disclosed by way of example with reference to the preferred embodiments, it is not intended to be limiting of the invention, and any person skilled in the art will, without departing from the spirit and scope of the invention, shall be protected by the scope of the claims.

The invention claimed is:

1. A back adjustable electrical bed frame, comprising a base, a back panel, a buttocks panel, a thigh panel and a shank panel, a back pusher motor and a leg pusher motor that are configured below the back panel, the leg pusher motor driving the buttocks panel and the shank panel, through a scissor support assembly, to move back and forth and be kept parallel to the base, wherein a back panel pivot is at a quarter to a half of a lower part of the back panel, the back panel is fixed to the base by a column, one end of the column is fixed to the base and the other end of the column is connected to the back panel pivot, a front end pivot of the back pusher motor is connected with the back panel, and a rear end pivot of the back pusher motor is fixedly connected with the base;

wherein the front end pivot of the back pusher motor, the rear end pivot of the back pusher motor and the back panel pivot form a triangle to position the angle of the back panel;

wherein one end of said thigh panel is rotatably connected to said buttocks panel by a hinge, and the other end of the thigh panel is rotatably connected to said shank panel by the hinge;

wherein two first scissors supports are side by side below the shank panel and are connected by a first intermediate pivot, two second scissors supports are side by side below the shank panel and are connected by a second intermediate pivot, four ends of the first scissors supports are free to slide, right lower ends of the second scissors supports are fixed to the base, and the other three ends of the second scissors supports are free to slide; and wherein left lower ends of the second scissors supports are connected by a scissors rod, said scissors rod and a leg pusher motor are connected.

2. The back adjustable electrical bed frame of claim 1, further comprising a head panel;

wherein said head panel is rotatably connected with the back panel by a hinge; and wherein a head motor front fastener is configured on said head panel, a head motor rear fastener is configured on said back panel, said head motor front fastener and said head motor rear fastener are connected to each other by means of a head fader motor to adjust the relative angle of said head panel and said back panel.

3. The back adjustable electrical bed frame of claim 1, wherein said back panel pivot is positioned at a third of the lower part of the back panel.

4. The back adjustable electrical bed frame of claim 1, wherein each of said four ends of the first scissors supports is disposed at a bearing chute by a rolling bearing; and wherein said right lower end of each of the second scissors supports is configured with a fixed rotary pivot and the other three ends of each of the second scissors supports are disposed in said bearing chute by rolling bearings.

5. The back adjustable electrical bed frame of claim 1, wherein said back pusher motor and said leg pusher motor are arranged side by side, and said back pusher motor and the leg pusher motor are fixed to the base by a double motor rear fastener.

6. The back adjustable electrical bed frame of claim 1, wherein said back pusher motor controls a lifting angle of the back panel by pulling the back panel.

* * * * *